US010622763B2

(12) United States Patent
Nakajima et al.

(10) Patent No.: US 10,622,763 B2
(45) Date of Patent: Apr. 14, 2020

(54) CONNECTOR

(71) Applicant: KYOCERA Corporation, Kyoto-shi, Kyoto (JP)

(72) Inventors: Nobuyuki Nakajima, Tokyo (JP); Yuusuke Shiroyama, Yokohama (JP); Fumihito Ikegami, Funabashi (JP)

(73) Assignee: KYOCERA Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 16/316,788

(22) PCT Filed: Jun. 22, 2017

(86) PCT No.: PCT/JP2017/023077

§ 371 (c)(1),
(2) Date: Jan. 10, 2019

(87) PCT Pub. No.: WO2018/012243

PCT Pub. Date: Jan. 18, 2018

(65) Prior Publication Data

US 2019/0296488 A1 Sep. 26, 2019

(30) Foreign Application Priority Data

Jul. 13, 2016 (JP) ..... 2016-138789

(51) Int. Cl.
*H01R 13/639* (2006.01)
*H01R 12/79* (2011.01)

(52) U.S. Cl.
CPC ..... *H01R 13/639* (2013.01); *H01R 12/79* (2013.01)

(58) Field of Classification Search
CPC .. H01R 12/79; H01R 23/722; H01R 13/6275; H01R 13/6272; H01R 13/639
(Continued)

(56) References Cited

U.S. PATENT DOCUMENTS 7,357,663 B2 * 4/2008 Wei ..... H01R 12/79 439/260
8,002,567 B2 * 8/2011 Hara ..... H01R 12/89 439/329

(Continued)

FOREIGN PATENT DOCUMENTS

CN 102623843 A 8/2012
JP 2007122894 A 5/2007

(Continued)

OTHER PUBLICATIONS

Sep. 26, 2017, International Search Report issued in the International Patent Application No. PCT/JP2017/023077.

*Primary Examiner* — Gary F Paumen
(74) *Attorney, Agent, or Firm* — Kenja IP Law PC

(57) ABSTRACT

Provided is a connector having reduced height and area that facilitates the retention and removal of a connection object while preventing damages to itself during operation. According to the present disclosure, a connector (10) includes an insulator (20) having an accommodation section (22) for allowing insertion of a connection object (an FPC 60), an actuator (40) attached to the insulator (20), and a locking member (50) that supports the connection object (the FPC 60) accommodated in the accommodation section (22) in an insertion-removal direction. When the actuator (40) is pushed in along a direction substantially orthogonal to the insertion-removal direction, the locking member (50) is elastically deformed and releases the connection object (the FPC 60).

5 Claims, 11 Drawing Sheets

(58) Field of Classification Search
USPC ..... 439/329, 357
See application file for complete search history.

(56) References Cited

U.S. PATENT DOCUMENTS

| | | | | |
|---|---|---|---|---|
| 8,678,844 | B2 | 3/2014 | Yoshisuji et al. | |
| 8,840,411 | B2 * | 9/2014 | Nakano ..... | H01R 12/79 439/260 |
| 2012/0238125 | A1 | 9/2012 | Yoshisuji et al. | |

FOREIGN PATENT DOCUMENTS

| | | | |
|---|---|---|---|
| JP | 2008004404 | A | 1/2008 |
| JP | 2012156088 | A | 8/2012 |
| JP | 2012212658 | A | 11/2012 |
| JP | 5344059 | B2 | 11/2013 |
| JP | 2014029769 | A | 2/2014 |

* cited by examiner

CONNECTOR

CROSS REFERENCE TO RELATED APPLICATION

This application claims priority to and the benefit of Japanese Patent Application No. 2016-138789 filed on Jul. 13, 2016, the entire contents of which are incorporated herein by reference.

TECHNICAL FIELD

The present disclosure relates to a connector for electrically coupling circuit boards together.

BACKGROUND

Conventionally, connectors to be connected to a connection object having a flat shape, such as a flexible printed circuit (FFC) board or a flexible flat cable (FFC), have been known. The connectors electrically couples the connection object such as the FPC or FFC to another circuit board.

For example, the connector described in PTL 1 set forth below includes an insulator that allows insertion and removal of a connection object, and an actuator rotatably supported by the insulator. When the actuator is rotated, a cam of the actuator acts such that a locking portion of the connector is inserted into a latch of the connection object. In this way, the connector described in the PTL 1 supports the connection object.

Similarly, the connector described in PTL 2 set forth below includes an insulator that allows insertion and removal of a connection object, and an actuator rotatably supported by the insulator. When the actuator is rotated, a cam of the actuator pushes a contact. In this way, the connection object may come into contact with the contact.

The connector described in PTL 3 set forth below includes an insulator that allows insertion and removal of a connection object, and an unlock-pushing portion integrally provided with the insulator. When the unlock-pushing portion is pushed down, a locking mechanism retaining the contact object unlocks and allows removal of the connection object from the connector.

CITATION LIST

Patent Literature

PTL 1: JP-A-2008-004404
PTL 2: JP-A-2007-122894
PTL 3: Japanese Patent No. 5344059

SUMMARY

Technical Problem

Incidentally, an increasing tendency to downsize electronic devices requires connectors mounted in the electronic devices to have reduced heights and areas. For example, when a connector having a height reduced as small as 1 mm from a substrate employs the actuator mechanism disclosed in the PTL 1 or the PTL 2 for retaining and unlocking a connection object, the actuator is necessitated to reduce its thickness and length. Consequently, rotation of the actuator becomes very difficult, thus deteriorating workability.

The connector described in the PTL 3 includes the unlock-pushing portion for releasing the connection object. However, a reduction in an area of the connector inhibits securing a sufficient length of the unlock-pushing portion. When the unlock-pushing portion is integrally formed with the insulator, a sufficient displacement amount necessary for the unlocking cannot be secured. Also, securing a thickness (rigidity) of the unlock-pushing portion becomes difficult, causing the unlock-pushing portion to be prone to deformation, bend or breakage during operation.

In light of such problems, the present disclosure aims to provide a connector having reduced height and area that facilitates the retention and removal of a connection object while preventing damages to itself during operation.

Solution to Problem

In order to solve the above problems, a connector in a first aspect includes:

an insulator having an accommodation section for allowing insertion of a connection object;

an actuator attached to the insulator; and a locking member that supports the connection object accommodated in the accommodation section in an insertion-removal direction, wherein, when the actuator is pushed in along a direction substantially orthogonal to the insertion-removal direction, the locking member is elastically deformed and releases the connection object.

According to the connector in a second aspect, each of the insulator and the actuator includes a push-restricting unit for regulating a displacement amount of the actuator being pushed in.

According to the connector in a third aspect, the push-restricting unit is constituted by an inclined portion constituting a part of an outer surface of the actuator, and a supporting abutment of the insulator which the inclined portion abuts during pushing.

According to the connector in a fourth aspect, the locking member is supported by the insulator and the actuator.

According to the connector in a fifth aspect, the locking member includes a portion that is elastically deformed when pushed by the actuator and has a substantially Z-shape along a direction substantially orthogonal to the insertion-removal direction.

According to the connector in a sixth aspect, the locking member includes a first bend and a second bend that correspond to two curved portions forming the substantially Z-shape, and the second bend has a curvature smaller than that of the first bend.

According to the connector in a seventh aspect, the actuator includes a projection that is formed on a side surface and engages with a recess formed on an inner surface of the insulator.

Advantageous Effect

The connector according to the present disclosure having a reduced height and area facilitates retention and removal of the connection object while preventing damage to the connector itself during operation.

BRIEF DESCRIPTION OF THE DRAWINGS

In the accompanying drawings:

FIG. 10 is a cross-sectional view corresponding to a state of FIG. 7 in which an actuator is pushed in; and FIG. 11 is a cross-sectional view corresponding to a state of FIG. 8 in which the actuator is pushed in.

DETAILED DESCRIPTION

Hereinafter, an embodiment of the present disclosure will be described with reference to the accompanying drawings. Terms such as a front-rear direction, a left-right direction, and an up-down direction used herein correspond to directions indicated by allows in the figures. In the following description, the front-rear direction in the figure corresponds to an "insertion-removal direction of an FPC 60", and the up-down direction in the figure corresponds to a "direction orthogonal to the insertion-removal direction of the FPC 60". However, they are not restrictive. For example, the up-down direction may correspond to the "insertion-removal direction of the FPC 60". In this case, the front-rear direction may correspond to the "direction orthogonal to the insertion-removal direction of the FPC 60".

In the following description, a connector 10 according to an embodiment is described as will be connected to, for example, an FPC 60 (a connection object), which is a flexible printed circuit board. However, this is not restrictive. The connector 10 may be any connector that electrically couples circuit boards together via a metal contact attached to an insulator. For example, the connector 10 may be coupled to a flexible flat cable in place of the flexible printed circuit board.

Figure 1:
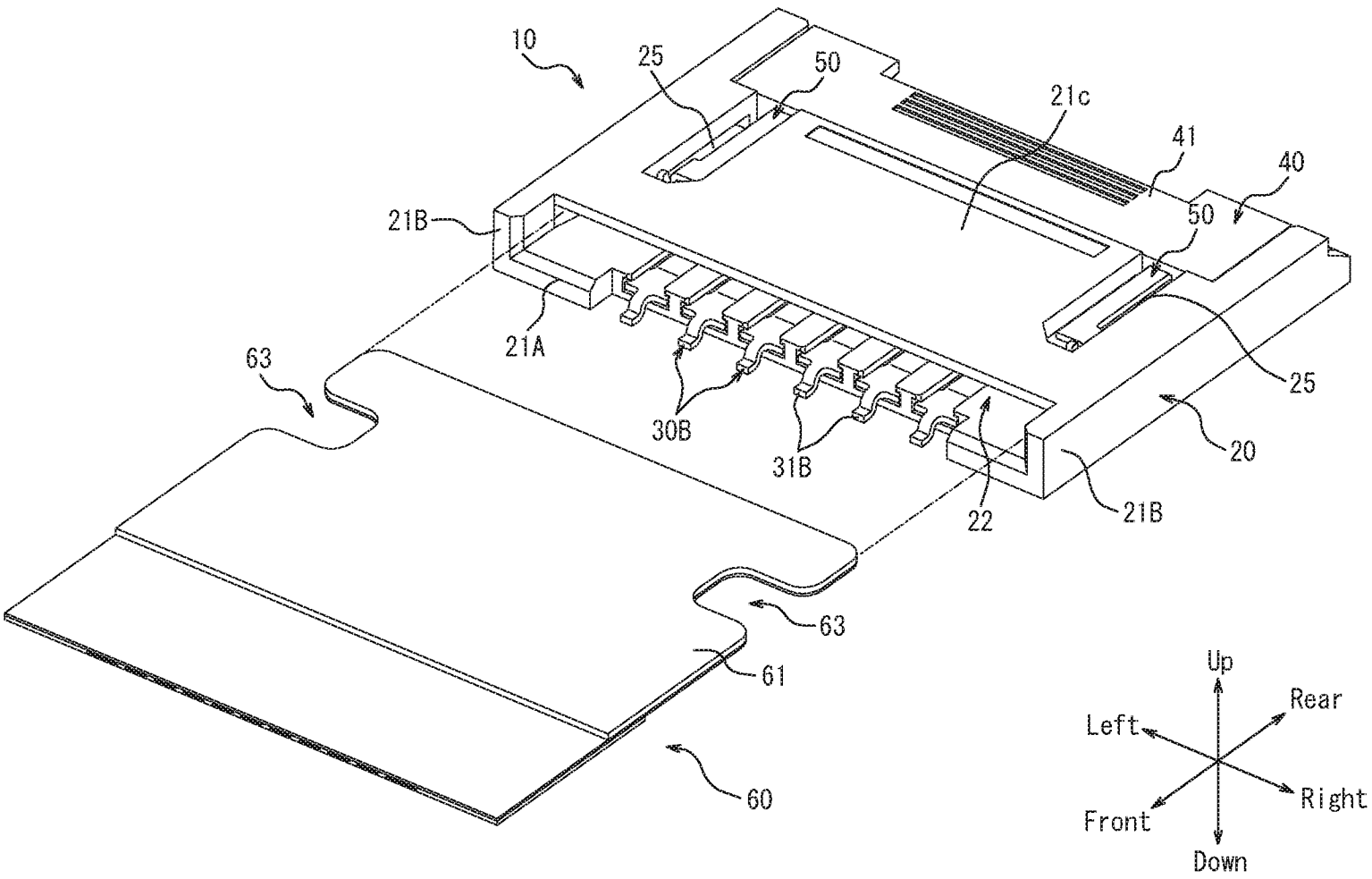
FIG. 1 is a top perspective view illustrating a state in which a connector and an FPC are separated from each other, according to an embodiment.
Figure 2:
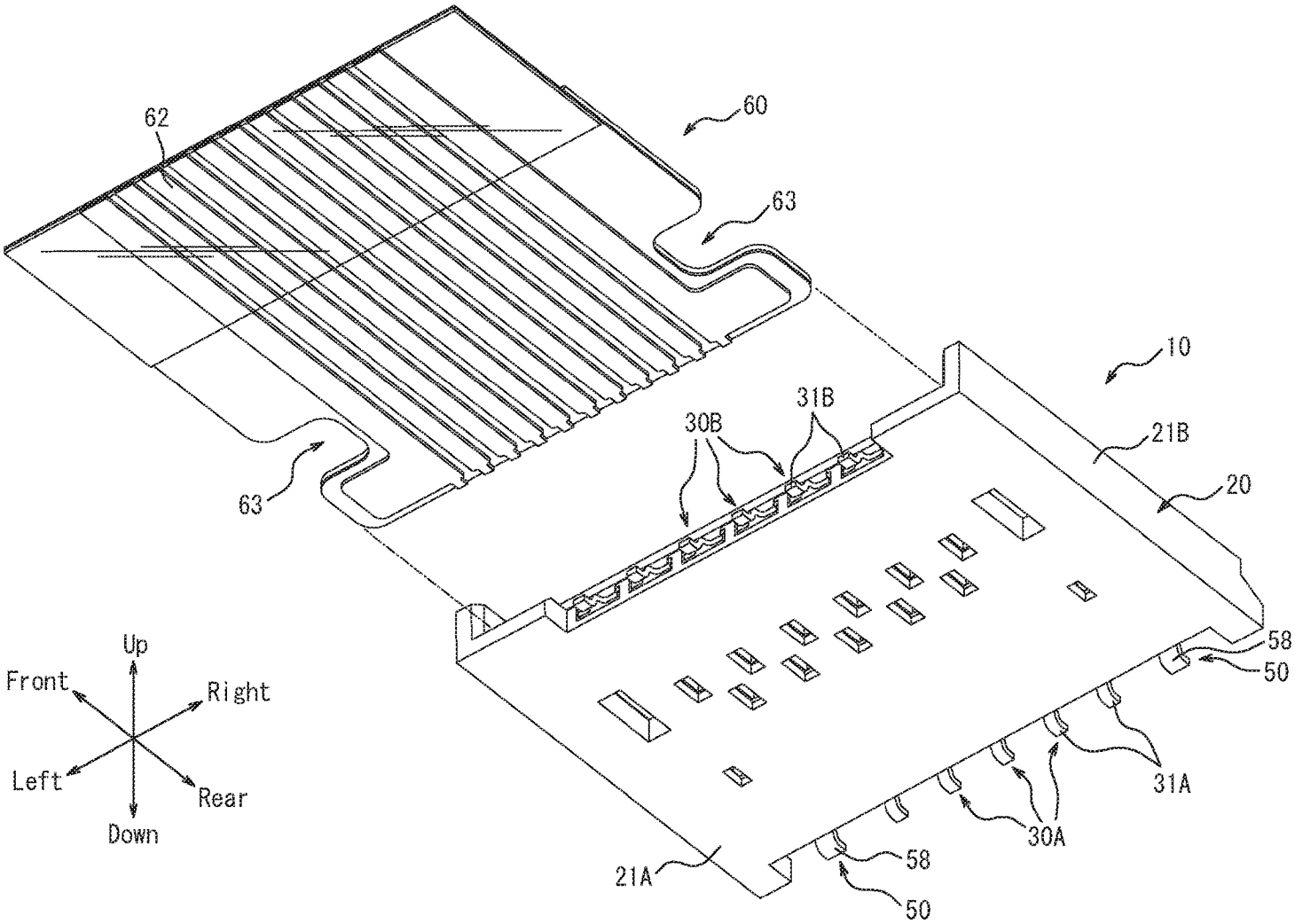
FIG. 2 is a bottom perspective view illustrating a state in which the connector and the FPC of FIG. 1 are separated from each other.
Figure 3:
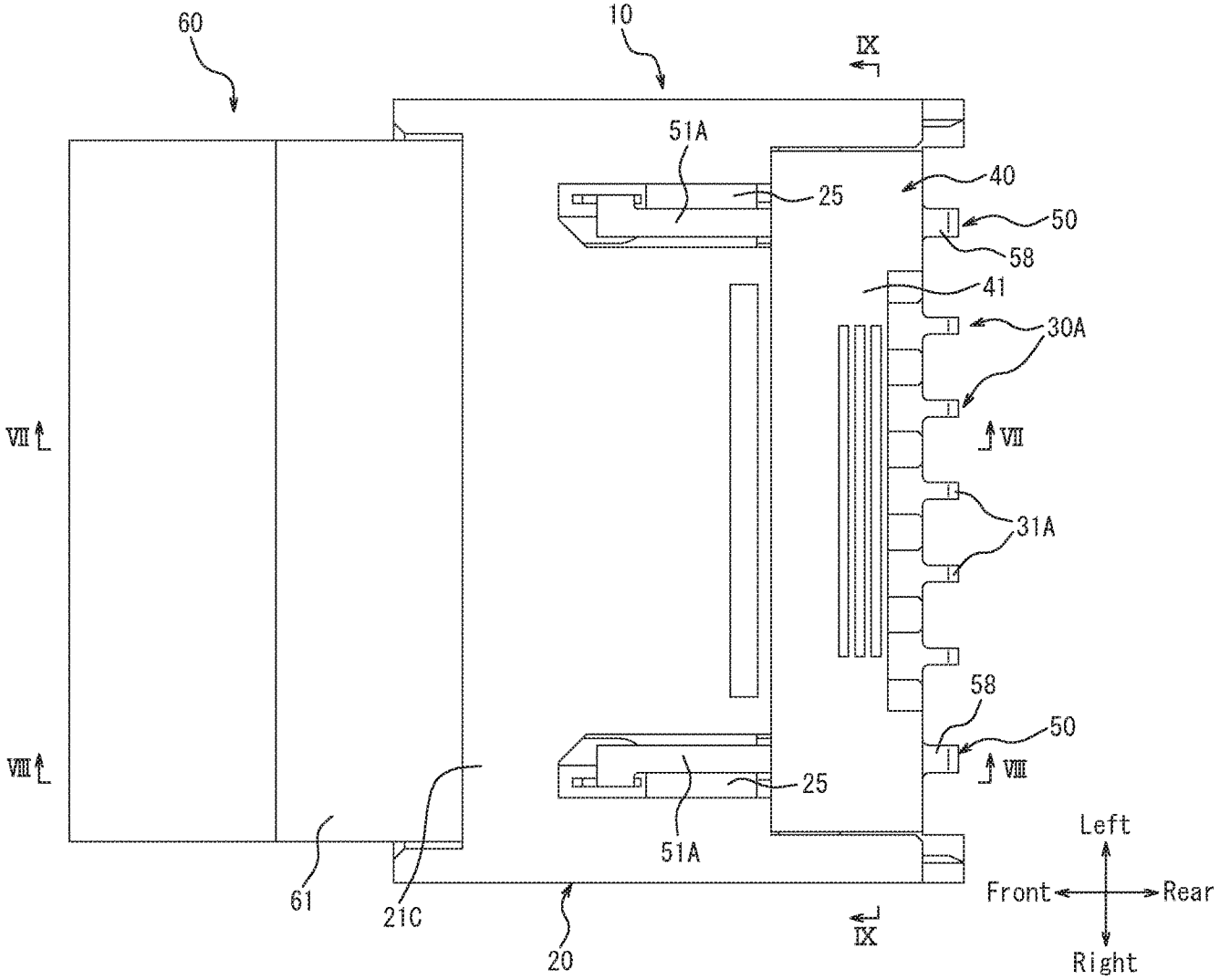
FIG. 3 is a top view of the connector having the FPC inserted thereinto.
Figure 4:
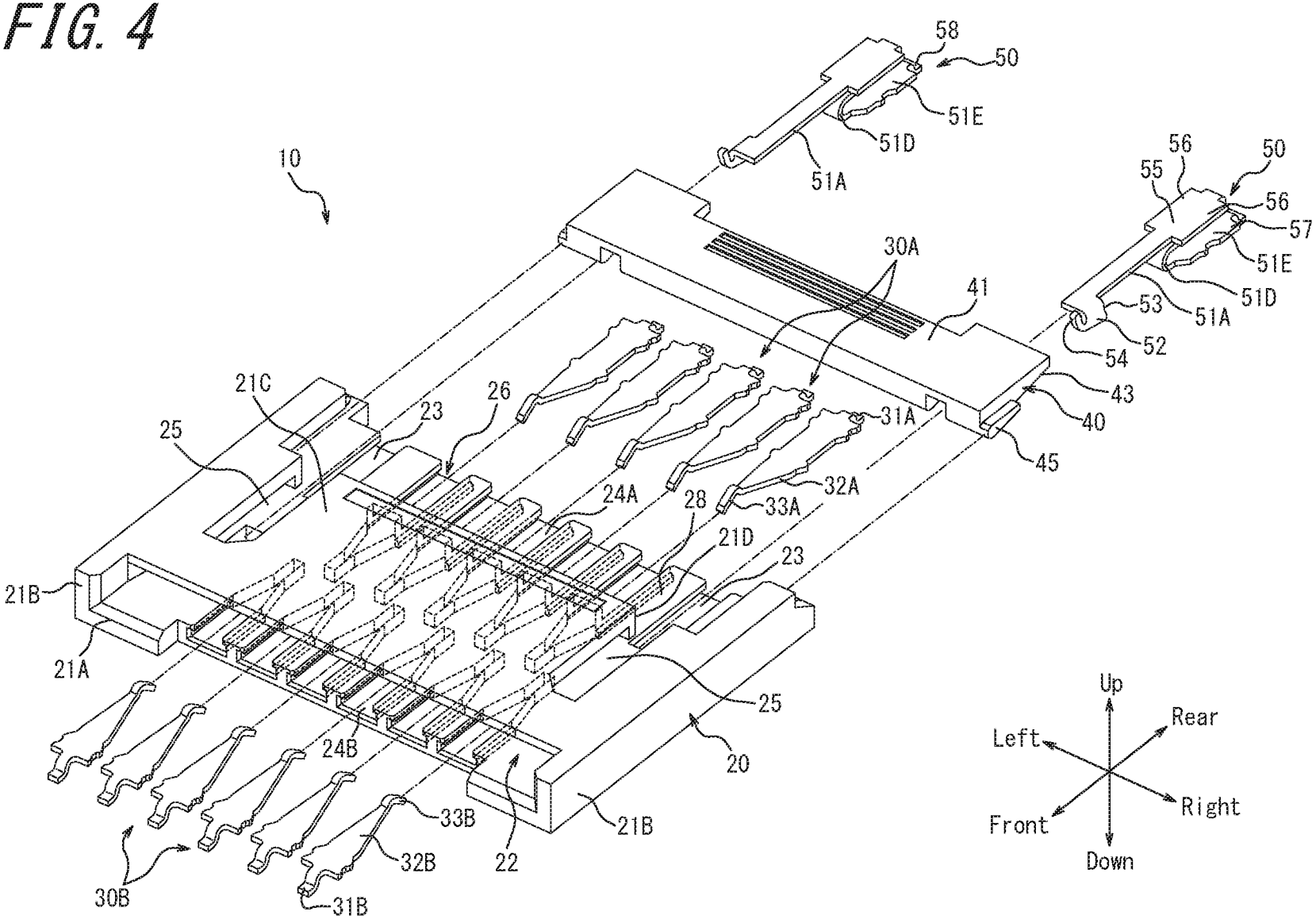
FIG. 4 is an exploded perspective view illustrating the connector viewed from above.
Figure 5:
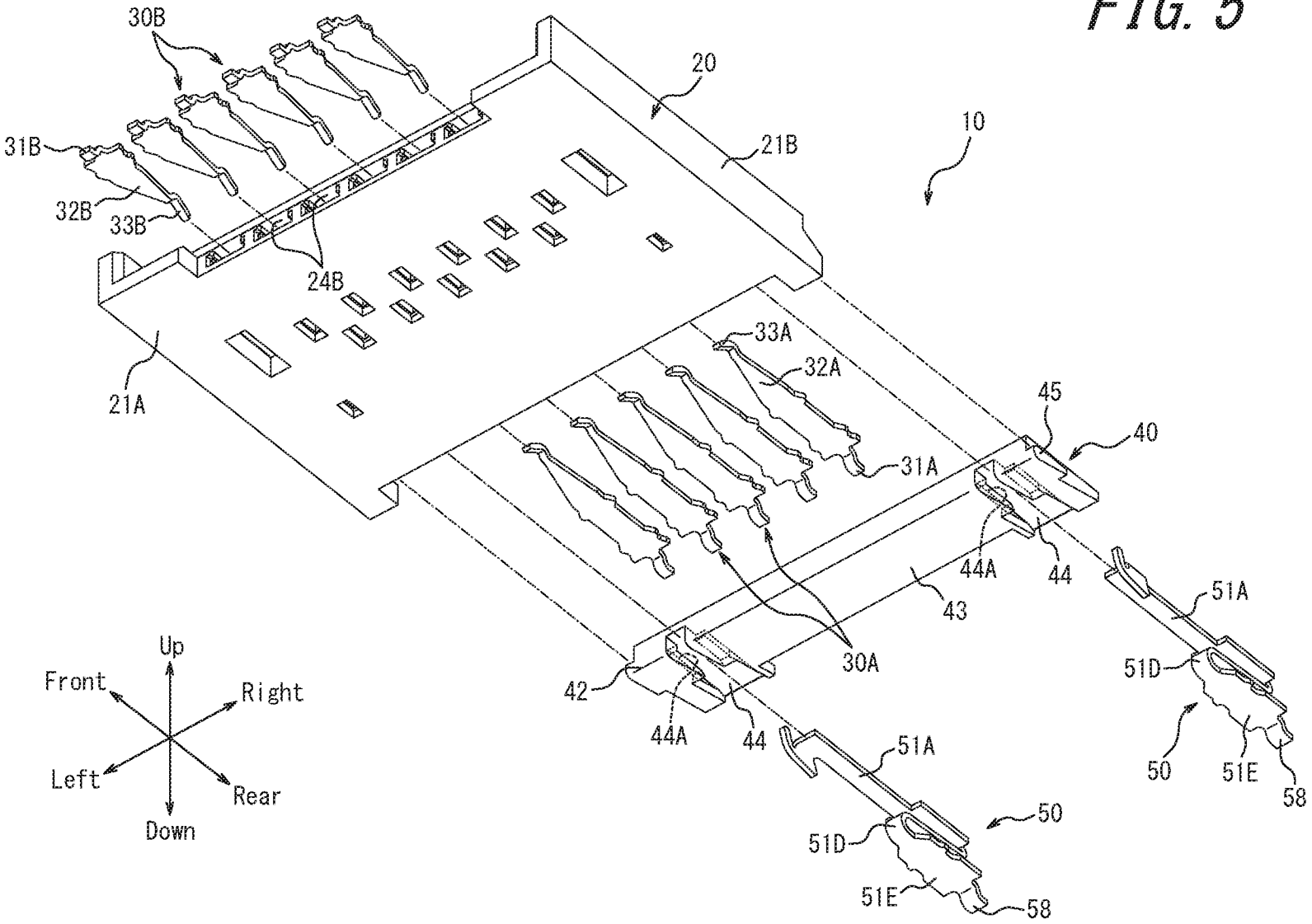
FIG. 5 is an exploded perspective view illustrating the connector viewed from below.
Figure 6:
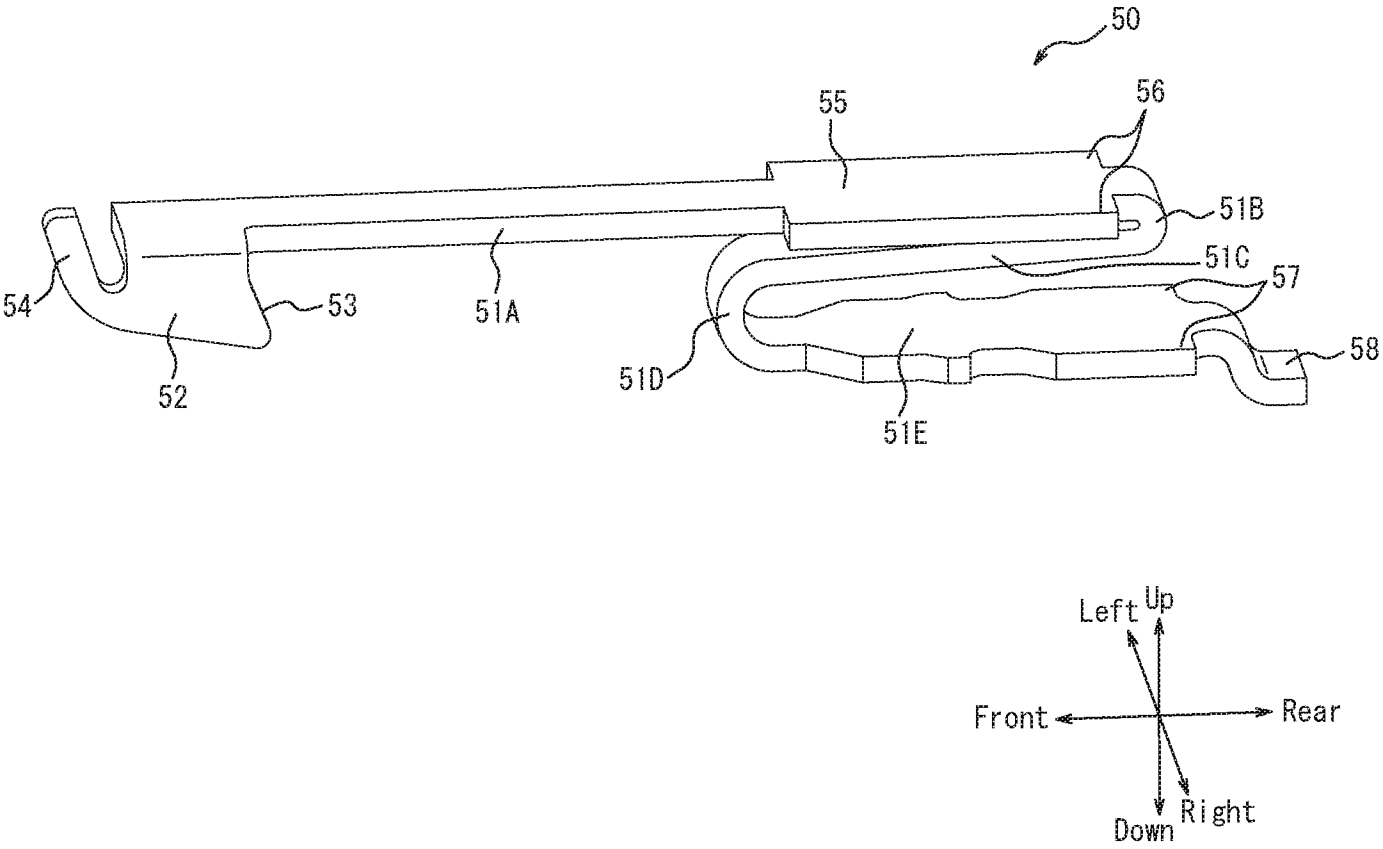
FIG. 6 is a perspective view of a locking member.
Figure 7:
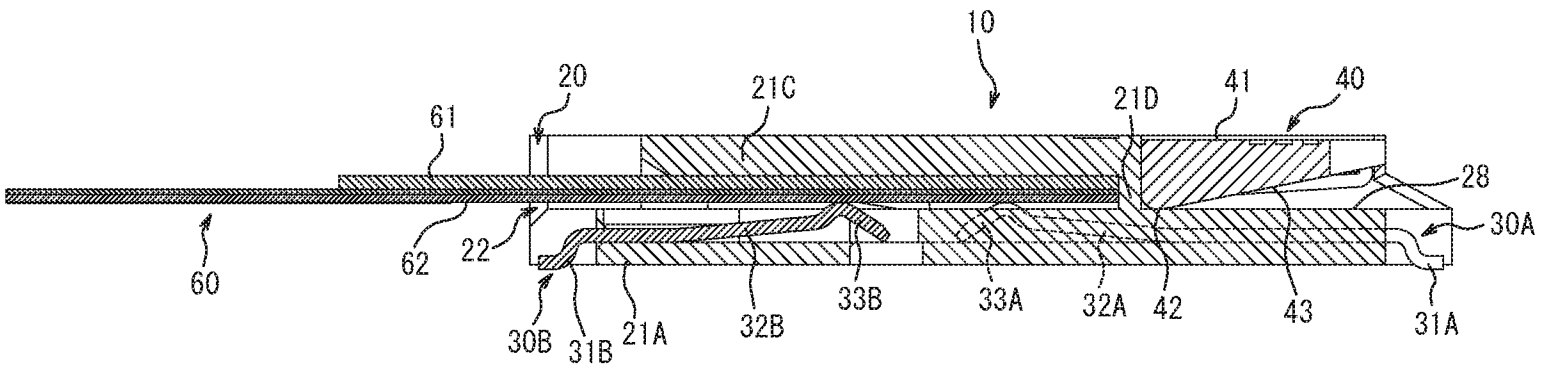
FIG. 7 is a cross-sectional view taken from arrow VII-VII of FIG. 3.
Figure 8:
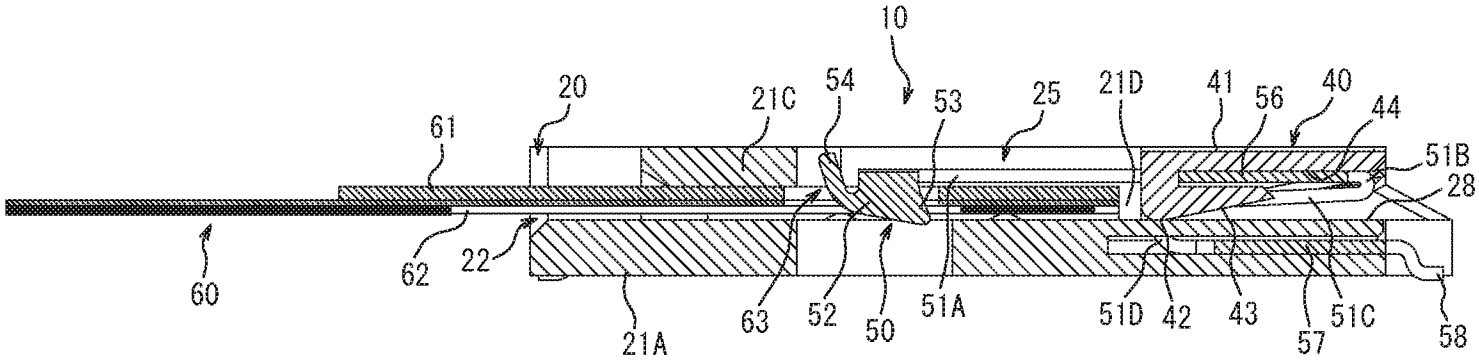
FIG. 8 is a cross-sectional view taken from arrow VIII-VIII of FIG. 3.
Figure 9:
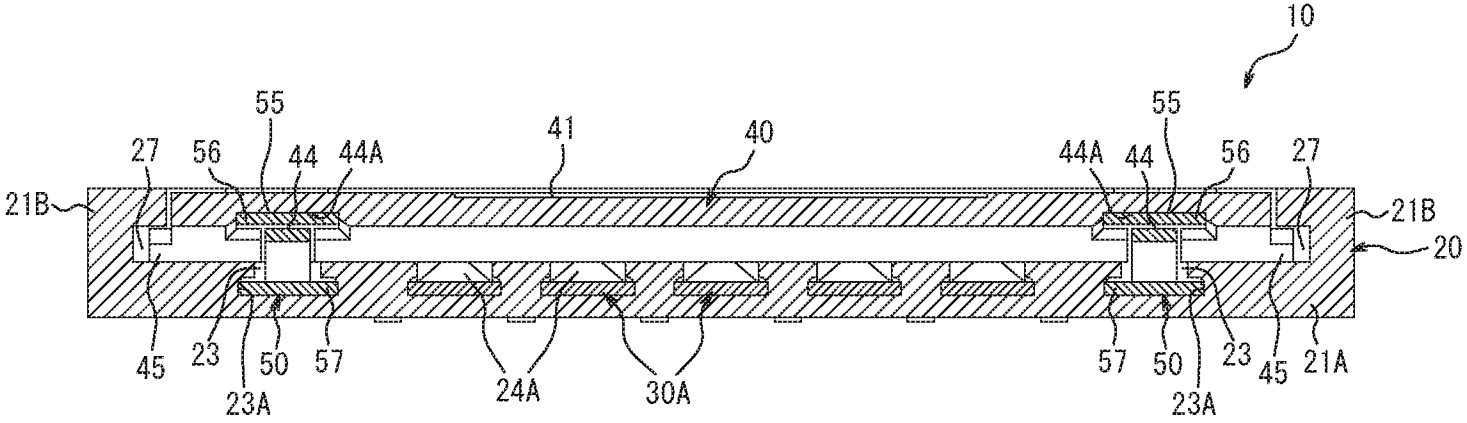
FIG. 9 is a cross-sectional view taken from arrow IX-IX of FIG. 3.
Figure 10:
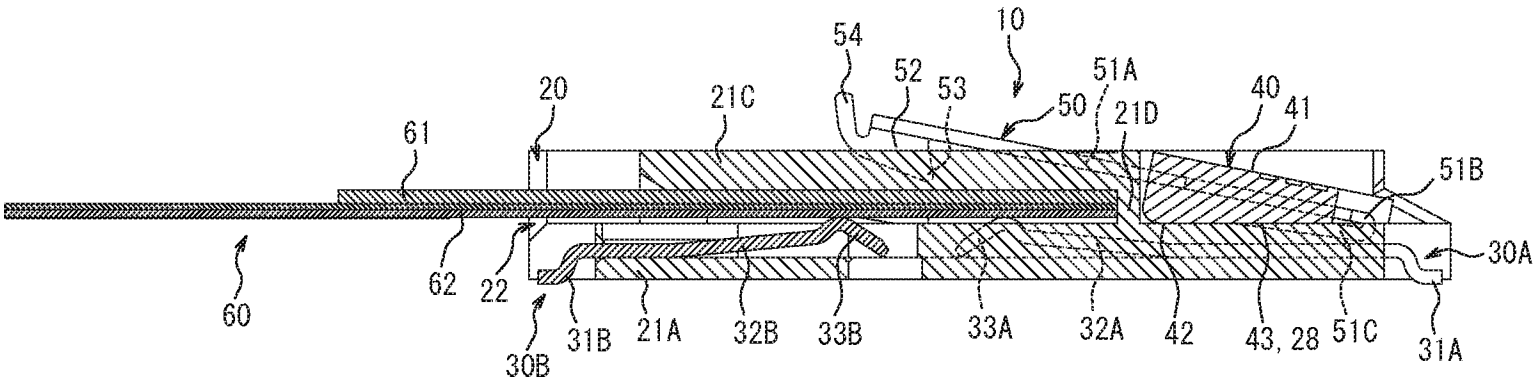
Figure 11:
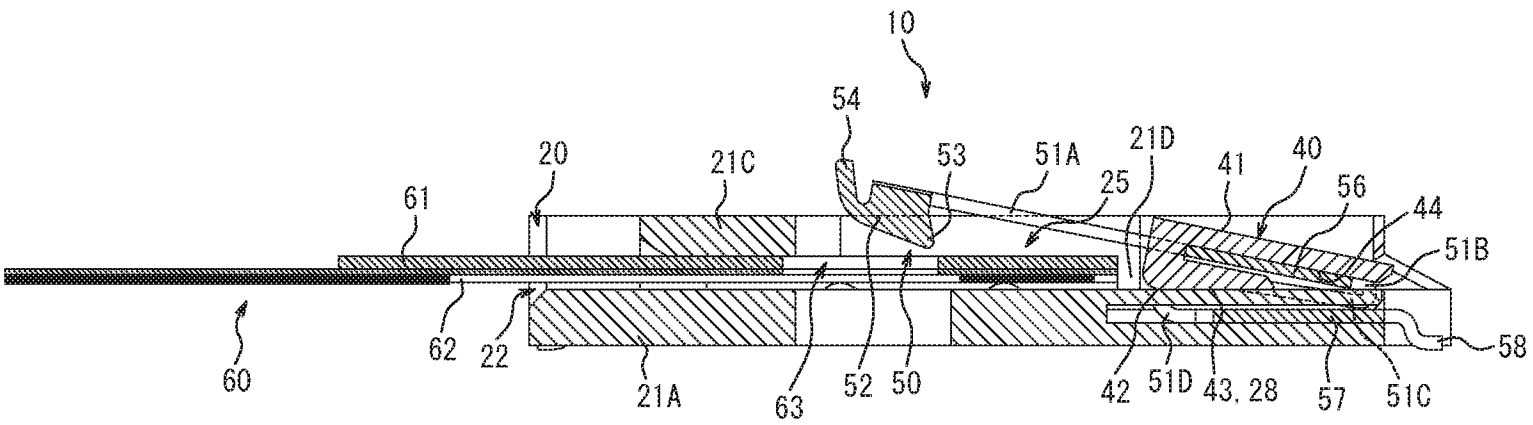

FIG. 1 is a top perspective view illustrating a state in which the connector 10 and the FPC 60 are separated from each other, according to the embodiment. FIG. 2 is a bottom perspective view illustrating the state in which the connector 10 and the FPC 60 of FIG. 1 are separated from each other. FIG. 3 is a top view of the connector 10 having the FPC 60 inserted thereinto. FIG. 4 is an exploded perspective view illustrating the connector 10 viewed from above. FIG. 5 is an exploded perspective view illustrating the connector viewed from below. FIG. 6 is a perspective view of a locking member 50. FIG. 7 is a cross-sectional view taken from arrow VII-VII of FIG. 3. FIG. 8 is a cross-sectional view taken from arrow VIII-VIII of FIG. 3. FIG. 9 is a cross-sectional view taken from arrow IX-IX of FIG. 3. FIG. 10 is a cross-sectional view corresponding to a state of FIG. 7 in which an actuator 40 is pushed in. FIG. 11 is a cross-sectional view corresponding to a state of FIG. 8 in which the actuator 40 is pushed in.

A configuration of the connector 10 according to the embodiment will be described.

As illustrated in FIG. 4, the connector 10 according to the embodiment primarily includes an insulator 20 extending in the left-right direction, and a plurality of first contacts 30A and a plurality of second contacts 30B that are alternately supported by the insulator 20. The connector 10 also includes the actuator 40 mounted in such a manner as to be able to be pushed downward with respect to the insulator 20, and two locking members 50 which are supported by the actuator 40 and support the FPC 60 in the insertion-removal direction, i.e., in the front-rear direction. The connector 10 is mounted on a circuit board. The connector 10 electrically couples the FPC 60 and the circuit board together via the plurality of first contacts 30A and the plurality of second contacts 30B.

The connector 10, by means of the locking member 50 supported by the insulator 20 and the actuator 40, retains the FPC 60 within the insulator 20. Also, the connector 10 causes elastic deformation of the locking member 50 in the up-down direction when the actuator 40 is pushed downward (along the direction orthogonal to the insertion direction of the FPC 60). In this way, the connector 10 causes the locking member 50 to release the FPC 60 and allows removal of the FPC 60 accommodated in the insulator 20.

The insulator 20 is formed by performing injection molding of a synthetic resin having electrically insulating and heat-resistant properties. As illustrated in FIG. 4, the insulator 20 includes a bottom plate 21A having a flat-plate shape. The insulator 20 includes a pair of side walls 21B extending upward at left and right ends of the bottom plate 21A. The insulator 20 also includes a top plate 21C that is formed opposite to the bottom plate 21A and couples the pair of side walls 21B together on the front side. The insulator 20 further includes a rear wall 21D extending downward from a rear end portion of the top plate 21C.

The insulator 20 includes an accommodation section 22 constituted by a space surrounded by the bottom plate 21A, the pair of side walls 21B, the top plate 21C, and the rear wall 21D. The accommodation section 22 accommodates the FPC 60. The accommodation section 22 opens on its front side. The FPC 60 may be inserted into or removed from the accommodation section 22. The rear end portion of the accommodation section 22 is closed by the rear wall 21D. When the FPC 60 is inserted into the accommodation section 22, the front end of the FPC 60 comes into contact with, or comes in close proximity to, the inner surface of the rear wall 21D.

The insulator 20 includes fixing bracket locking grooves 23 which are formed on the top surface of the bottom plate 21A and extend in the front-rear direction at left and right ends in a rear portion. The fitting bracket locking grooves 23 are rectangular recesses formed on the top surface of the bottom plate 21A. The fitting bracket locking grooves 23 include, on their bottom, attaching sections 23A wider in the left-right direction than a left-right direction width of the upper portion of the fitting bracket locking grooves 23 (see FIG. 9). Each of the fitting bracket locking grooves 23 retains a corresponding locking member 50 inserted thereinto.

The top surface of the bottom plate 21A of the insulator 20 includes a plurality of first contact locking grooves 24A and a plurality of second contact locking grooves 24B extending in the front-rear direction (see FIG. 4). The plurality of first contact locking grooves 24A are formed in a line in the left-right direction in the rear portion of the bottom plate 21A. The plurality of second contact locking grooves 24B are formed in a line in the left-right direction in the front portion of the bottom plate 21A. The first contact locking grooves 24A are located slightly offset in the left-right direction from the respective closest second contact locking grooves 24B. That is, the plurality of first contact locking grooves 24A and the plurality of second contact locking grooves 24B are formed in a staggered arrangement in the left-right direction. The plurality of first contact engaging grooves 24A are formed in the rear portion of the bottom plate 21A between the pair of fitting bracket locking groove 23 in the left-right direction. Each of the first contact locking grooves 24A receives and retains a corresponding first contact 30A. Each of the second contact locking grooves 24B receives and retains a corresponding second contact 30B.

The insulator 20, at either left and right end of the accommodation section 22, includes a slit 25 formed as a recess extending in the front-rear direction.

The insulator 20 includes an actuator accommodation section 26 that is adjacent to the rear surface of the rear wall 21D and extends in the left-right direction. The insulator 20 also includes a recess 27 formed on the inner surface of the insulator 20 in a lower rear portion of the pair of side walls 21B (see FIG. 9). As will be described later, the insulator 20 supports the actuator 40 by means of the actuator accommodation section 26 and the recess 27 in a manner allowing the actuator 40 to be pushed in.

The insulator 20 includes a supporting abutment 28 constituted by the bottom surface of the actuator accommodation section 26, i.e., the top surface of the bottom plate 21A located on a rear side of the accommodation section 22. The supporting abutment 28 is configured such that a corresponding outer surface of the actuator 40 abuts the supporting abutment 28 when the actuator 40 is being pushed, which will be described later.

The first contact 30A and the second contact 30B are formed by molding, into the shapes as illustrated in the figures, a thin plate of copper alloy (e.g., phosphor bronze, beryllium copper, titanium copper) or Corson copper alloy having a spring elasticity by using a progressive die (stamping) in a thickness direction (see FIG. 4 and FIG. 5). The first contact 30A and the second contact 30B are inserted into and supported by the first contact locking groove 24 and the second contact locking groove 24B, respectively, of the insulator 20. The first contact 30A and the second contact 30B are molded into a shape that is wide in the left-right direction and thin in the up-down direction. This enables a reduction in the height of the connector 10 as a whole.

The first contact 30A, in its rear end portion, includes a mounting portion 31A that is bent in a substantially L-shape. The first contact 30A includes an elastic deformation portion 32A that extends obliquely upward on a front side with respect to the mounting portion 31A. In the vicinity of the front end of the elastic deformation portion 32A, a contact projection 33A is bent upward. The mounting portion 31A is soldered to a corresponding circuit pattern provided on the circuit board. During insertion of the FPC 60, the contact projection 33A comes into contact with a corresponding circuit pattern 62 of the FPC 60 (see FIG. 7 and FIG. 10).

The second contact 30B, in its front end portion, includes a mounting portion 31B that is bent in a substantially L-shape. The second contact 30B includes an elastic deformation portion 32B that extends obliquely upward on a rear side with respect to the mounting portion 31B. In the vicinity of the rear end portion of the elastic deformation portion 32B, a contact projection 33B is bent upward. The mounting portion 31B is soldered to a corresponding circuit pattern provided on the circuit board. During insertion of the FPC 60, the contact projection 33B comes into contact with a corresponding circuit pattern 62 of the FPC 60 (see FIG. 7 and FIG. 10).

The actuator 40 is obtained by performing injection molding of a synthetic resin material having a heat-resistant property by using a metallic mold. The actuator 40 is supported by the insulator 20 in such a manner as to be able to be pushed downward along a direction substantially orthogonal to the insertion-removal direction of the FPC 60. The actuator 40 is accommodated within the actuator accommodation section 26 of the insulator 20 with the front end surface of the actuator 40 in contact with, or in close proximity to, the outer surface of the rear wall 21D of the insulator 20 (see FIG. 1 and FIG. 4). The actuator 40 includes a pushing portion 41 constituted by the top surface thereof. The pushing portion 41 is formed into a substantially horizontal surface so as to receive a pressure directing from up to down when the actuator 40 is not pushed in.

The actuator 40 includes a contact portion 42 that comes into contact with the insulator 20 and serves as a fulcrum for pushing the insulator 20 downward (see FIGS. 7 and 8). The actuator 40 includes an inclined portion 43 that constitutes a portion of an outer surface thereof, in particular, a bottom surface of the actuator 40. The inclined portion 43 is formed in a substantially flat shape and extends obliquely upward at a predetermined angle from the contact portion 42 in the rear direction.

The actuator 40 includes a pushing abutment 44 that is formed as a recess on the surface of the inclined portion 43 and abuts the top surface of the locking member 50 (see FIG. 5 and FIG. 8). The pushing abutment 44 as a recess extends upward on the surface of the inclined portion 43. The pushing abutment 44 is narrowed in its front portion having a shape in conformance with a shape of a corresponding portion of the locking member 50. The pushing abutment 44 is widened in its rear portion having a shape in conformance with a shape of a corresponding portion of the locking member 50. The pushing abutment 44 includes, in its top end portion, a mounting portion 44A formed to be wider in the left-right direction than a left-right direction width of a lower portion of the pushing abutment 44 (see FIG. 5 and FIG. 9). Each of the pushing abutments 44 supports a corresponding locking member 50 inserted thereinto.

The actuator 40 includes, in a lower front end of either side surface thereof, a projection 45 that fits in the recess 27 formed on the inner surface of the insulator 20.

As illustrated in FIG. 6, the locking member 50 is a metal material formed into a substantially Z-shape. The locking member 50 is molded to be wide in the left-right direction and low in the up-down direction. This enables the reduction in the height of the connector 10 as a whole. Especially, the locking member 50 includes a substantially Z-shape portion along the up-down direction that is elastically deformed when the actuator is pressed in. That is, the locking member 50 includes an arm 51A constituting a top portion thereof, a first bend 51B in a semicircular shape formed continuously from the rear end of the arm portion 51A, and a connecting portion 51C extending obliquely downward in the front direction from the first bend 51B. The locking member 50 also includes a second bend 51D in a semicircular shape formed continuously from the connecting portion 51C and a base 51E that is formed continuously from the second bend 51D and constitutes a bottom portion of the locking member 50.

As the locking member 50 has the substantially Z-shape, the arm 51A is inclined in the direction orthogonal to the insertion-removal direction of the FPC 60, that is, the arm 51A is lifted upward. The arm 51A is provided with a locking portion 52 that is bent downward on an outer front side of the arm 51A (i.e., on the left side with respect to the locking member 50 to be inserted into the left end portion of the insulator 20, and on the right side with respect to the locking member 50 to be inserted into the right end portion of the insulator 20). That is, the locking portion 52 projects downward from the outer side of the front end of the arm 51A. The locking portion 52 includes an opposing portion 53 which is inclined rearward from the top to bottom of the locking portion 52. The locking portion 52 also includes a claw 54 projecting obliquely upward in the front direction from the front end thereof.

The locking member 50 includes an abutment surface 55 that comes into contact with the pushing abutment 44 of the actuator 40. The abutment surface 55 is constituted by the top surface of the arm 51A. The abutment surface 55 is narrow in its front portion and wide in its rear portion.

The locking member 50 includes an attaching projection 56 that engages with the mounting portion 44A of the actuator 40. The attaching projection 56 protrudes in the left-right direction on the rear side of the arm 51A. The top surface of the attaching projection 56 forms a part of the abutment surface 55.

The first bend 51B constitutes the upper bend of the substantially Z-shape. The first bend 51B is formed at substantially the same height as the abutment surface 55 of the arm 51A and continuous thereto. The first bend 51B is formed such that the inner surface of the bend having a semicircular shape is directed in the front direction.

The second bend 51D constitutes the lower bend of the substantially Z-shape. The second bend 51D is located below the abutment surface 55 and the first bend 51B and formed such that the inner surface thereof having a semicircular shape is directed in the rear direction. That is, the second bend 51D is formed opposite to the inner surface of the first bend 51B. The second bend 51D has a curvature smaller than that of the first bend portion 51B. That is, the radius of curvature of the second bend 51D is greater than that of the first bend 51B.

The base 51E includes an attaching projection 57 that engages with the attaching portion 23A of the insulator 20. The attaching projection 57 projects in the left-right direction on the rear side of the base 51E.

The locking member 50 also includes a mounting portion 58A that is bent in a substantially L-shape at the rear end of the base 51E. The mounting portion 58 is soldered to a corresponding circuit pattern provided on the circuit board.

As illustrated in FIG. 1 and FIG. 2, the FPC 60 has a laminated structure in which a plurality of thin materials are attached to one another. The FPC 60 includes an end portion reinforcing member 61 that constitutes either end thereof in the longitudinal direction and is harder than the other portion, and a plurality of circuit patterns 62 that linearly extend along the extending direction to the bottom surface of the end portion reinforcing member 61. The plurality of circuit patterns 62 are arranged in a line in the left-right direction and, when the FPC 60 is inserted into the connector 10, come into contact with the contact projection 33A of the first contact 30A and the contact projection 33B of the second contact 30B that are arranged alternately.

The FPC 60 also includes locked portions 63 on the left and right ends thereof in a manner recessing in the left-right direction. When the locked portions 63 of the left and right ends of the FPC 60 engage with (fit in) the locking portion 52 of the locking member 50, an insertion position of the FPC 60 is determined and, simultaneously, the FPC 60 is retained within the accommodation section 22 (see FIG. 8).

A procedure for assembling the connector 10 will be described with reference to FIG. 4.

Each of the plurality of second contacts 30B is inserted into a corresponding one of the second contact locking grooves 24B formed on the front side of the bottom plate 21A of the insulator 20. Each of the plurality of first contacts 30A is inserted into a corresponding one of the first contact locking grooves 24A formed on the rear side of the bottom plate 21A of the insulator 20.

The locking member 50 is provisionally inserted into the actuator 40. In this case, the attaching portion 44A formed on the pushing abutment 44 of the actuator 40 and the attaching projection 56 of the locking member 50 engage with each other (see FIG. 9).

In the insulator 20 having the first contact 30A and the second contact 30B inserted and supported therein, the locking member 50 provisionally inserted into the actuator 40 is press-fitted. In this case, the mounting portion 23A formed in the fixing bracket engaging groove 23 of the insulator 20 and the attaching projection 57 of the locking member 50 engage with each other (see FIG. 9). Simultaneously, the recess 27 formed on the inner surface of the insulator 20 and the projection 45 of the actuator 40 engage with each other.

When each component is attached to the insulator 20 as described above, the contact portion 42 of the actuator 40 comes into contact with the supporting abutment 28 of the insulator 20 (see FIG. 8). This causes the pushing abutment 44 of the actuator 40 to come into contact with the locking member 50. Thus, the actuator 40 is supported by the insulator 20 and the locking member 50 within the actuator accommodation section 26 of the insulator 20.

The portion of the locking member 50 constituting a front portion of the arm 51 is located within the slit 25 formed on either left and right end of the accommodation section 22 of the insulator 20. That is, this portion of the arm 51A, especially the claw 54, is clearly visible from above.

The operation of each component when the FPC 60 is inserted into the connector 10 will be described with reference to FIG. 8.

When the front end of the FPC 60 is inserted into the accommodation section 22 in the rear direction via the opening on the front side of the accommodation section 22 of the insulator 20, the front end of the FPC 60 contacts the claw 54 of the locking member 50 located within the slit 25. The claw 54 is inclined obliquely upward in the front direction and causes power of resistance generated by contacting the FPC 60 to act obliquely upward in the rear direction. Accordingly, when the front end of the FPC 60 is further inserted into the accommodation section 22 in the rear direction while being in contact with the claw 54, the top end of the arm 51A of the locking member 50 is lifted up. In this case, substantially an entirety of the claw 54 formed at the front end of the arm 51A protrudes from the slit 25. Simultaneously, the locking portion 52 of the arm 51A moves onto the top surface of the end portion reinforcing member 61 of the FPC 60. In this case, in conjunction with the upward displacement of the front end of the arm 51A, the rear end portion of the actuator 40 is displaced downward, having the contact portion 42 (the engaging portion between the recess 27 formed on the inner surface of the insulator 20 and the projection 45) serving as a fulcrum. Concurrently, the second bend 51D of the locking member 50 is elastically deformed in the contracting direction. Then, when the FPC 60 is further inserted into the accommodation section 22 in the rear direction, the top surface of the end portion reinforcing member 61 of the FPC 60 slides on the bottom surface of the locking portion 52. When the FPC 60 is further moved in the rear direction, the locking portion 52 of the locking member 50 engages with (fits in) the locked portion 63 of the FPC 60. This causes the claw 54 formed at the front end of the arm 51A to fit in the slit 25. Simultaneously, the front end of the FPC 60 comes into contact with, or comes in close proximity to, the inner surface of the rear wall 21D of the insulator 20.

Thus, the insertion position of the FPC 60 is determined and, simultaneously, the FPC 60 is retained within the accommodation section 22. That is, the locking member 50 retains, in the insertion-removal direction, the FPC 60 that is supported by the insulator 20 and the actuator 40 and accommodated within the accommodation section 22. Accordingly, the connector 10 is capable of retaining the FPC 60 when the FPC 60 is inserted thereinto without an operation of the actuator 40 by a person.

Operation of each component when the FPC 60 is removed from the connector 10 will be described with reference to FIG. 10 and FIG. 11.

In a state in which the FPC 60 is retained within the accommodation section 22 of the insulator 20, a person pushes down the pushing portion 41 of the actuator 40. A pressure applied to push down the pushing portion 41 pushes down the actuator 40. That is, the rear end portion of the actuator 40 is displaced downward, having the contact portion 42 (the engaging portion between the recess 27 formed on the inner surface of the insulator 20 and the projection 45) serving as a fulcrum. In particular, the rear end portion of the actuator 40 is shifted in an arc, having the pushing portion 41 serving as the fulcrum.

When the actuator 40 is pushed down to the maximum, the inclined portion 43 of the actuator 40 and the supporting abutment 28 of the insulator 20 abut each other. This makes the person unable to push the actuator 40 further, thus determining a pushing position of the actuator 40. That is, the inclined portion 43 of the actuator 40 and the supporting abutment 28 of the insulator 20 together function as a push-restricting unit for limiting a displacement amount of the actuator 40 when pushed.

When the actuator 40 is pushed down, the actuator 40 delivers the pressure to the locking member 50 via the inner surface of the pushing abutment 44, causing the elastic deformation of the locking member 50. In particular, the actuator 40 shifts the first bend 51B of the locking member 50 downward. Simultaneously, the actuator 40 transitions a vertical inclination of the connecting portion 51C from the obliquely downward inclination in the front direction to the obliquely upward inclination in the front direction. Thus, the actuator 40 causes the elastic deformation of the second bend 51D of the locking member 50 in its contracting direction.

In this case, the first bend 51B of the locking member 50 abuts, or comes in close proximity to, the base 51E. Simultaneously, the front end of the arm 51A of the locking member 50 is lifted up. This causes substantially an entirety of the claw 54 formed at the front end of the arm 51A to protrude from the slit 25. An upward displacement amount of the top end portion of the arm 51A of the locking member 50 and a protruding position of the claw 54 are determined in accordance with the displacement amount of the actuator 40 from a support position of the actuator 40 to a position where the push-restricting unit restricts the pushing as described above.

In this way, the locking portion 52 of the locking member 50 and the locked portion 63 of the FPC 60 become disengaged from each other, allowing the removal of the FPC 60 accommodated in the accommodation section 22 in the front direction.

When a person stops pushing down the actuator 40 and the pressure applied to the pushing portion 41 is released, a restoration force of the locking member 50 causes the arm 51A of the locking member 50, the first bend 51B, the connection portion 51C, and the second pend 51D to restore their original shapes and locations. Simultaneously, the abutment between the inclined portion 43 of the actuator 40 and the supporting abutment 28 of the insulator 20 is released, allowing the actuator 40 to move back to the support position before being pushed. As a result, all of the components of the connector 10 restores their original states.

The connector 10 as described above having reduced height and area facilitates the retention and removal of the FPC 60 while preventing damages to the connector 10 itself during operation. That is, the connector 10 eliminates the necessity for the operation of the actuator 40 by a person when the FPC 60 is inserted and thus enables easy retention of the FPC 60 by simply inserting the insulator 20 into the accommodation section 22 of the insulator 20. For removal of the FPC 60, a person may unlock the FPC 60 by simply pushing the actuator 40. Accordingly, the connector 10 having reduced height and area is capable of securing workability.

The connector 10 includes the insulator 20 and the actuator 40 configured as individual components. Thus, the connector 10 having reduced height and area is capable of maintaining rigidity of each of them and less likely to be damaged. That is, the insulator 20 and the actuator 40 may maintain their rigidity and prevent deformation, bend and damages thereof.

The connector 10 includes the insulator 20 and the actuator 40 configured as individual components. Thus, even when the connector 10 has reduced height and area, the connector 10 is capable of increasing the displacement amount of the actuator 40 being pushed, as compared to a conventional connector having an insulator and an actuator that are integrally formed. Thus, the connector 10 may reliably disengage between the locking portion 52 of the locking member 50 and the locked portion 63 of the FPC 60 when a person pushes the actuator 40.

The connector 10 includes the insulator 20 and the actuator 40 configured as individual components. Thus, the connector 10 may reduce the width thereof in the front-rear direction, as compared to a conventional connector having an insulator and an actuator that are integrally formed. This enables further downsizing of the connector 10.

The connector 10 includes the push-restricting units (the inclined portion 43 of the actuator 40 and the supporting abutment 28 of the insulator 20) and thus prevents excessive pushing by a person. This prevents, during removal of the FPC 60, damage to each component including the insulator 20, the actuator 40, and the locking member 50.

The connector 10 includes the push-restricting units constituted by a pair of abutment surfaces and thus is capable of further reliably limiting the pushing of the actuator 40. That is, the connector 10 causes a surface contact between the inclined portion 43 of the actuator 40 and the supporting abutment 28 of the insulator 20, and thus further reliably limits the pushing of the actuator 40.

The connector 10 has the locking member 50 in the substantially Z-shape, and thus is capable of efficiently converting the displacement caused by the pushing of the actuator 40 into the elastic deformation of locking member 50. The second bend 51D formed at the front end of the locking member 50 is elastically deformed in a contracting manner. Thus, the connector 10 may convert a downward displacement of the actuator 40 caused by the pushing into the upward displacement of the front end of the arm 51A of the locking member 50.

The second bend 51D has a curvature smaller than that of the first bend 51B. Thus, the connector 10 may cause a large elastic deformation of the locking member 50 with the second bend 51D, which is located below the first bend 51B, serving as the fulcrum. That is, the connector 10 may increase the upward displacement of the front end of the arm 51A of the locking member 50.

The connector 10 causes the projection 45 of the actuator 40 and the recess 27 formed on the inner surface of the insulator 20 engage with each other, and thus is capable of stably retaining the actuator 40 within the actuator accommodation section 26 by suppressing the restoring force of the locking member 50. The connector 10, by virtue of this engagement, is capable of preventing the actuator 40 from rotating in a direction opposite to the pushing direction and disengaging from the insulator 20.

The connector 10 includes the opposing portion 53 that is inclined in the rear direction from the top to the bottom of the locking portion 52, and thus is capable of causing the locking portion 52 of the locking member 50 to more tightly fit in the locked portion 63 of the FPC 60. That is, the connector 10 can firm up the engagement between the locking portion 52 of the locking member 50 and the locked portions 63 of the FPC 60.

The connector 10 includes the claw 54 formed at the front end of the arm 51A in a visible manner through the slit 25, and thus enables visual confirmation whether the FPC 60 is fully inserted. That is, in a state where the FPC 60 is not fully inserted into the accommodation section 22, the claw 54 is located on the top surface of the end portion reinforcing member 61 and protrudes from the slit 25. Accordingly, when the claw 54 remains protruding during insertion of the FPC 60, it may be readily determined that the FPC 60 is not fully inserted.

It is apparent to those who are skilled in the art that the present disclosure may be substantialized in forms other than the embodiment described above, without departing from the spirit and the fundamental characteristics of the present disclosure. Accordingly, the foregoing description is provided by way of example only in a non-limiting manner. The scope of the present disclosure is defined by the appended claims, not by the foregoing descriptions. Among all modifications, those within a range of the equivalent to the present disclosure shall be considered as being included in the present disclosure.

Although the locking member 50 has been described as having the substantially Z-shape in the above description, this is not restrictive. The locking member 50 may be any member that has a mechanism to be able to release the FPC 60 when the actuator 40 is pushed in. For example, the locking member 50 may have only one bend. The locking member 50 may include two arms that are substantially parallel with each other with a space therebetween in the up-down direction, and a connecting portion connecting the two arms in the up-down direction near the centers of the arms. That is, the locking member 50 may have an H-shape rotated by 90 degrees. In this case, when one end of the upper arm is pushed down, the other end is shifted upward.

Although the push-restricting units have been described as being constituted by a pair of abutment surfaces, this is not restrictive. The push-restricting units may have any configuration that is capable of restricting the pushing of the actuator 40. For example, the push-restricting units may be constituted by a projection formed on the surface of the insulator 20 and a corresponding surface portion of the actuator 40. In this case, when the corresponding surface portion of the actuator 40 comes into contact with the projection, the pushing of the actuator 40 is restricted.

Although the connector 10 has been described as having a configuration in which the projection 45 of the actuator 40 and the recess 27 formed on the inner surface of the insulator 20 engage with each other, this is not restrictive. The connector 10 may have any configuration that is capable of retaining the actuator 40 and preventing the displacement of the actuator 40. For example, the connector 10 may have the projection and the recess interchanged with each other.

Although the connector 10 is described as having, for example, the first contact 30A and the second contact 30B that are molded to be thin in the up-down direction so as to be inserted into the insulator 20 as they stand, this is not restrictive. The connector 10 may be configured such that a contact soldered to the circuit board is inserted into and supported by the insulator 20 in a state in which, for example, the contact stands in the up-down direction.

REFERENCE SIGNS LIST

10 connector
20 insulator
21A bottom plate
21B side wall
21C top plate
21D rear wall
22 accommodation section
23 fitting bracket locking groove
23A mounting portion
24A first contact locking groove
24B second contact locking groove
25 slit
26 actuator accommodation section
27 recess
28 supporting abutment (push-restricting unit)
30A first contact
30B second contact
31A, 31B mounting portion
32A, 32B elastic deformation portion
33A, 33B contact projection
40 actuator
41 pushing portion
42 contact portion
43 inclined portion (push-restricting unit)
44 pushing abutment
44A attaching portion
45 projection
50 locking member
51A arm
51B first bend
51C connecting portion
51D second bend
51E base
52 locking portion
53 opposing portion
54 claw
55 abutting surface
56, 57 attaching projection
58 mounting portion
60 FPC (connection object)

61 end portion reinforcing member
62 circuit pattern
63 locked portion

The invention claimed is:

1. A connector comprising:

an insulator including an accommodation section for allowing insertion of a connection object and a recess formed on an inner surface of said insulator;

an actuator including a projection that engages with the recess and attached to said insulator to be rotatable about said projection; and a locking member engaging with said insulator and said actuator and supporting said connection object accommodated in said accommodation section in an insertion-removal direction, wherein said projection projects from a side surface of said actuator in a longitudinal direction of said actuator and, when said actuator is pushed in along a direction substantially orthogonal to said insertion-removal direction and said longitudinal direction, said locking member is elastically deformed and releases said connection object.

2. The connector according to claim 1, wherein each of said insulator and said actuator includes a push-restricting unit for regulating a displacement amount of said actuator being pushed in.

3. The connector according to claim 2, wherein said push-restricting unit is constituted by an inclined portion constituting a part of an outer surface of said actuator, and a supporting abutment of said insulator which said inclined portion abuts during pushing.

4. The connector according to claim 1, wherein said locking member includes a portion that is elastically deformed when pushed by said actuator and has a Z-shape along a direction substantially orthogonal to said insertion-removal direction and said longitudinal direction.

5. The connector according to claim 4, wherein said locking member includes a first bend and a second bend that correspond to two curved portions forming the Z-shape, and said second bend has a curvature smaller than that of said first bend.

* * * * *